United States Patent [19]

Wozniak

[11] Patent Number: 4,662,153

[45] Date of Patent: May 5, 1987

[54] ADJUSTABLE CONTAINER CAPPING APPARATUS

[76] Inventor: Mitchell S. Wozniak, 5660 Eden Rock La., NW., Atlanta, Ga. 30342

[21] Appl. No.: 825,321

[22] Filed: Feb. 3, 1986

[51] Int. Cl.[4] ..... B65B 7/28; B67B 1/06

[52] U.S. Cl. ..... 53/331.5; 53/317; 53/334

[58] Field of Search ..... 53/317, 331.5, 334, 53/335, 336, 490

[56] References Cited

U.S. PATENT DOCUMENTS

| | | | |
|---|---|---|---|
| 1,517,740 | 12/1924 | Malmquist | 53/334 |
| 2,076,631 | 4/1937 | Gantzer | 53/317 |
| 2,237,614 | 4/1941 | Perrone | 53/336 |
| 2,933,873 | 4/1960 | Swanson | 53/334 |
| 3,336,728 | 8/1967 | Monaco | 53/334 |
| 3,771,285 | 11/1973 | Bertario | 53/334 |
| 3,775,944 | 12/1973 | Roberts | 53/334 |
| 3,831,344 | 8/1974 | Over | 53/334 |
| 4,277,929 | 7/1981 | Schindel | 53/331.5 |

*Primary Examiner*—Robert L. Spruill
*Assistant Examiner*—Donald R. Studebaker
*Attorney, Agent, or Firm*—Rodgers & Rodgers

[57] ABSTRACT

Apparatus for applying container caps of different sizes to containers includes a main housing arranged for rotation by a driving spindle, an upwardly biased cam rod coaxially disposed relative to the spindle and movable reciprocably, a releasable holding device normally restraining the cam rod against upward movement, a transverse cam follower shaft mounted in a transverse passage formed in the cam rod and having outwardly projecting ends, on which a pair of cam followers are rotatable, a main cam fixed in position relative to the main housing and disposed about the cam rod and having opposed vertical cam tracks in which the outwardly projecting cam followers are disposed, a helix cam arranged for limited angular movement and disposed about the cam rod and within the main cam and having opposed helical cam tracks in which the outwardly projecting ends of the transverse cam followers are disposed whereby limited angular movement is imparted to the helix cam by the biasing means upon release of the cam rod by the releasable holding device, gripping mechanism supported by the housing for lightly gripping a container cap in coordination with limited angular movement of the helix cam and an adjustable worm arranged to change the angular position of the main cam relative to the main housing thereby to adapt the apparatus for use in conjunction with container caps of different diameters.

24 Claims, 11 Drawing Figures

ADJUSTABLE CONTAINER CAPPING APPARATUS

TECHNICAL FIELD

This invention pertains to apparatus for applying screw type caps to containers and is specially adapted for use in conjunction with container caps of different diameters.

BACKGROUND ART

U.S. Pat. No. 2,076,631 issued Apr. 13, 1937 discloses a capping mechanism for applying screw type caps to containers. This particular mechanism is not adaptable for use in conjunction with container caps of different diameters.

DISCLOSURE OF THE INVENTION

According to this invention in one form, apparatus for capping containers of different sizes is provided and includes a chuck comprising a main housing arranged for rotation by a driving spindle, a main gear having an axis coaxial with the axis of the driving spindle and also having gear teeth about at least a portion of its periphery and disposed within the main housing, a helix cam including a cam gear coaxially disposed with respect to said main gear, means including a cam rod engageable with a cap for imparting predetermined cap clamping movement to said cam gear relative to said main housing, a plurality of clamp shafts disposed about said main gear and said cam gear and rotatably mounted in said main housing and having outer ends projecting out of said main housing, a plurality of gear segments respectively mounted on said clamp shafts and having gear teeth in operative engagement with the teeth of said cam gear for respectively angularly shifting said clamp shafts in coordination with relative angular movement of said main housing and said cam gear, cap clamping means respectively secured to the outer ends of the clamp shafts, and adjusting means for imparting relative angular movement to said main housing and said main gear about the axes thereof for adjusting the chuck for use in conjunction with container caps of different diameters.

BEST MODE OF CARRYING OUT THE INVENTION

Figure 1:
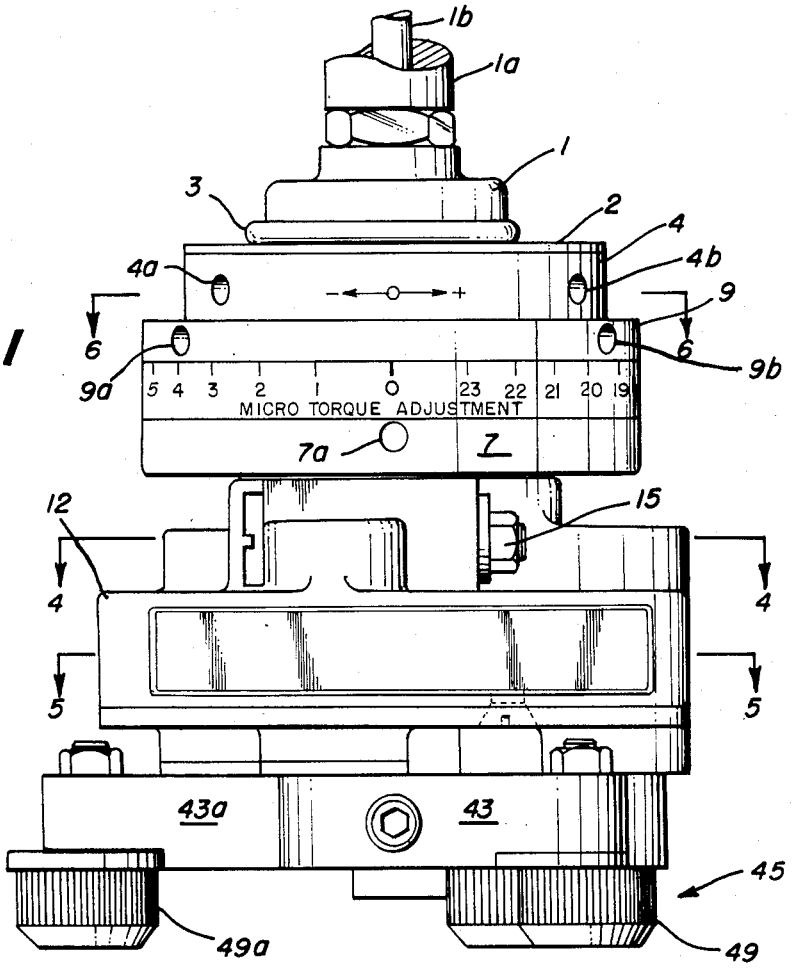
FIG. 1 is an overall side view of a container capping apparatus chuck formed according to this invention.
Figure 2:
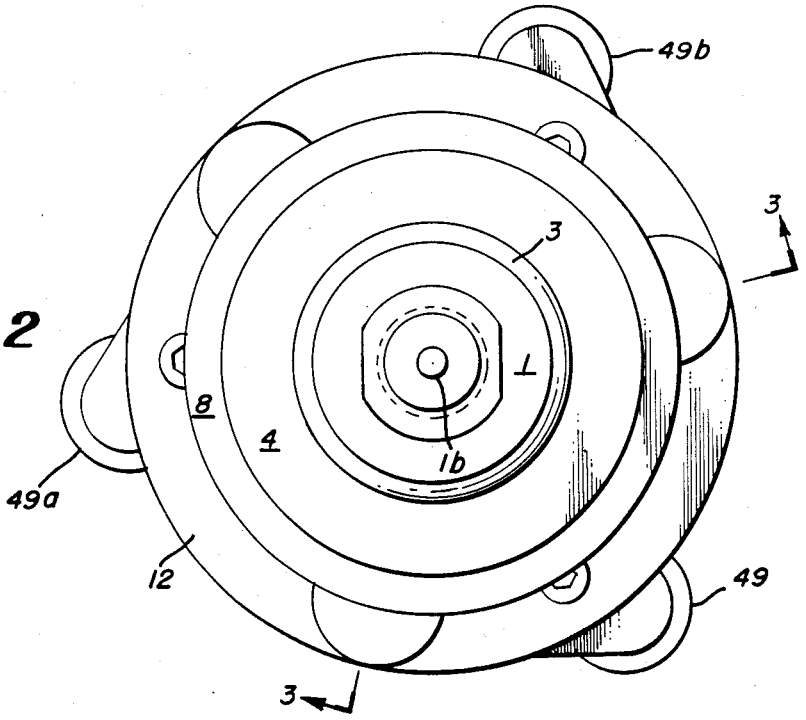
FIG. 2 is a top view of the device shown in FIG. 1.
Figure 3:
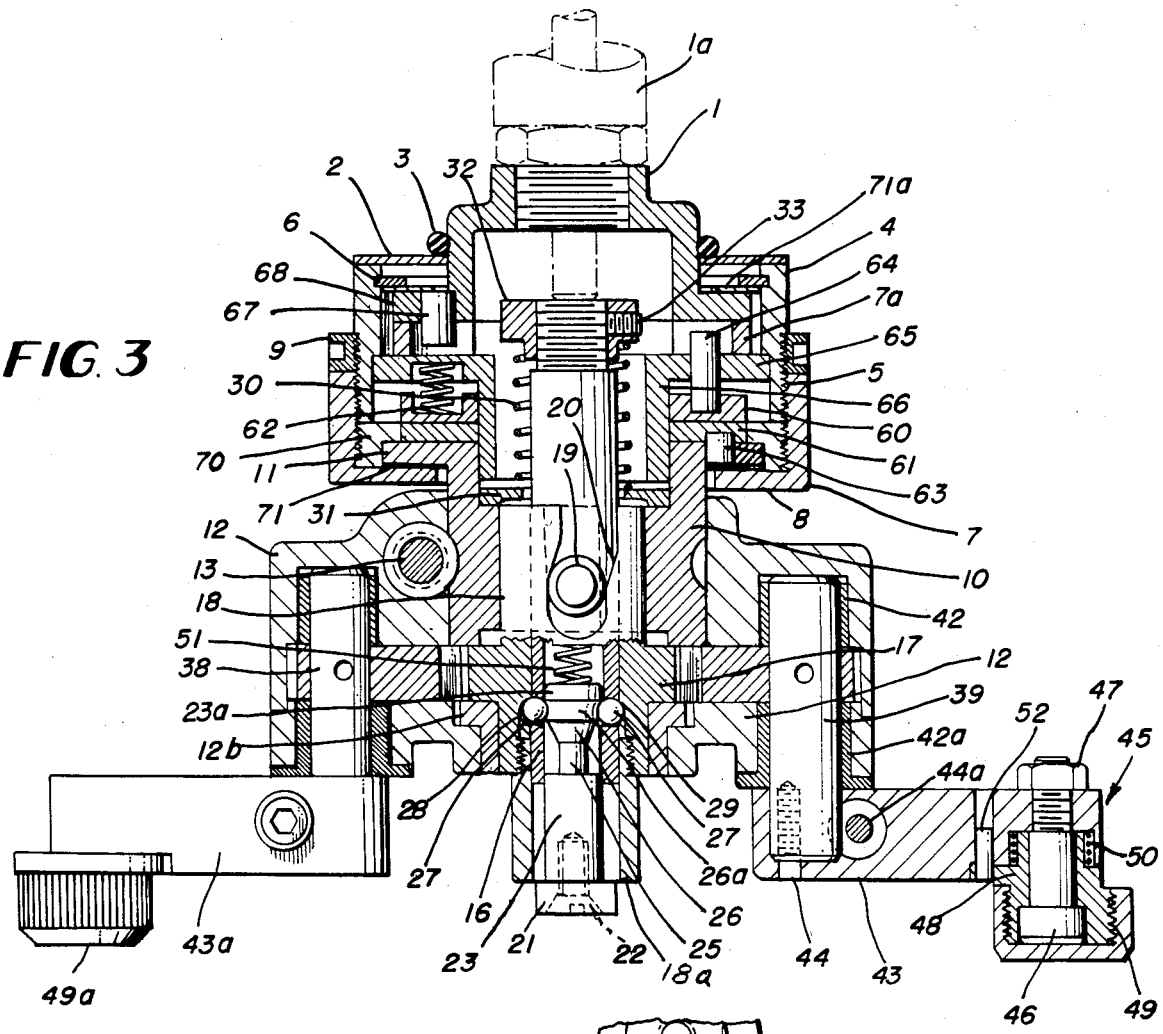
FIG. 3 is a cross sectional view taken along the lines designated 3—3 in FIG. 2.

With reference to FIGS. 1 and 3 a bell housing 1 is provided and is secured by known means with a driving spindle 1*a* so that rotation of the driving spindle imparts rotation to the bell housing 1. A chuck cover 2 is secured about bell housing 1 by an O ring 3. A sleeve 4 is externally threaded as indicated at 5 about the lower portion thereof and is secured in position by retaining ring 6 which also retains the internal structure of the chuck in place. an adjustable ring 7 having an inwardly projecting flange 8 at its lower end is secured to sleeve 4 by threads 5 and is locked in a preselected position by locking ring 9 which is adjustable to establish a desired frictional holding relation between the lower surface of locking ring 9 and the upper surface of adjustable ring 7. Calibrating indicia is formed on the outer periphery of ring 7 and the minimum torque setting is indicated at "O" on sleeve 4. Rotation of ring 7 in one direction or the other increases and decreases the magnitude of torque applied to the container cap. Holes 4*a*, 4*b*, 7*a*, 7*b* and 9*a* and 9*b* receive the prongs of a spanner wrench W.

Figure 4:
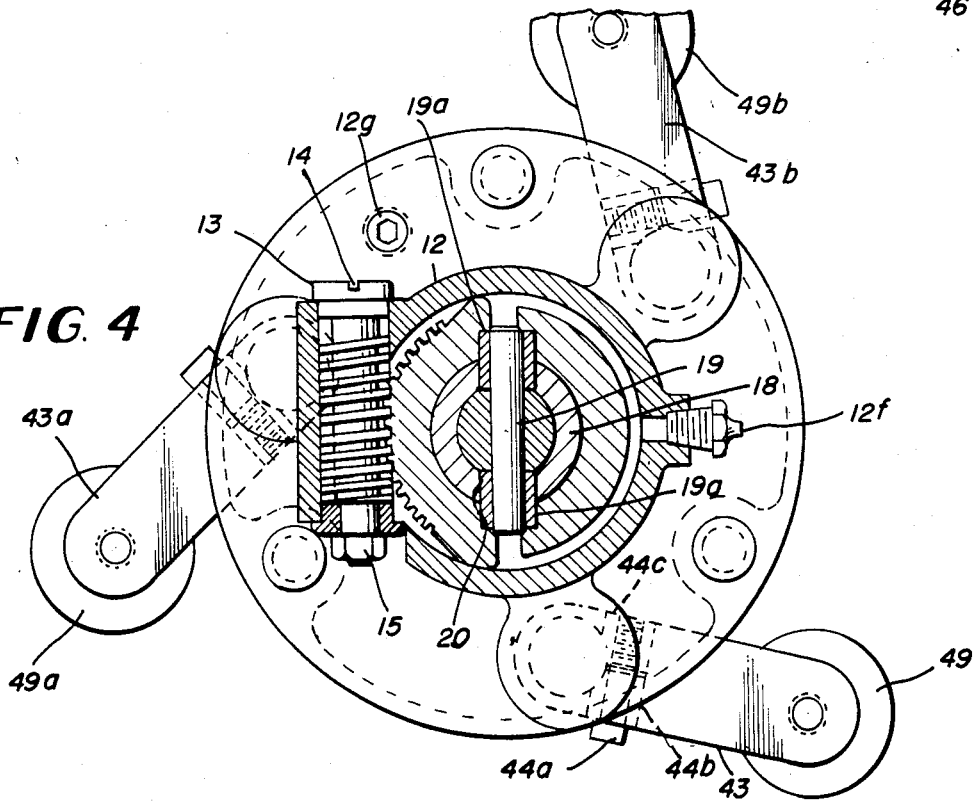
FIG. 4 is a cross sectional view taken along the line designated 4—4 in FIG. 1.

As shown in FIGS. 3 and 4, a main gear 10 has an upper outer flange 11 which is disposed above the flange 8 of adjustable ring 7. A main housing 12 is disposed about main gear 10 and is adjustable in angular relation thereto by a rotatable worm 13 having a slot 14 in one end thereof for facilitating rotation of the worm 13 by a screwdriver. Worm 13 is locked in a desired position by the lock nut 15. Rotation of worm 13 changes the angular relationship between main gear 10 and main housing 12 thereby to adapt the chuck for use in conjunction with container caps of different diameters as will be explained.

With the adjustment of worm 13 in a predetermined manner so as to condition the chuck for use in conjunction with a container cap of a particular diameter, the mechanism is arranged to lightly grip a container cap and then to position such cap immediately above a container onto which the cap is to be screwed before imparting cap tightening rotation to the cap. Toward this end a cam rod 16 is disposed within a cam gear 17 having an integral upwardly extending helix cam 18 into which a stop 18*a* for engaging small caps is secured and having a bearing 12*b*. Cam rod 16 is provided with transverse openings in which cam follower shaft 19 is arranged with cam followers 19*a* rotatably mounted on its outer ends and disposed within the diametrically opposed tracks 10*a* in main gear 10. A spiral cam track 20 is formed in helix cam 18 and the outer ends of cam follower shaft 19 having cam followers 19*a* disposed in vertical tracks 10*a* formed in main gear 10 so that vertical motion of cam rod 16 relative to helix cam 18 imparts limited angular movement to helix cam 18 and to cam gear 17 relative to main gear 10 which is fixed in position relative to the main housing 12 due to the particular setting of worm 13.

In order to release the cam rod 16 for vertical movement, the entire chuck is lowered so as to cause the buttonhead 21 which is held in place by the screw 22 to the lower end of stem 23 to engage the upper surface of a cap (not shown) to be applied thereby to impart upward movement to stem 23. Stem 23 is provided with an upper peripheral portion 23*a* which is larger in diameter than a lower peripheral portion 25, a conically shaped structure 26 and surface 26*a* configured to conform with the radius of balls 27 being interposed between peripheral portions 23*a* and 25. The larger peripheral flange like part 23*a* engages the balls 27 to hold the stem in locking position. Balls 27 are disposed within suitable openings 27*a* formed in cam rod 16 and are in engagement with ledges 28 and 29 on cam gear 17 as shown in FIG. 3 at the beginning of a capping operation. Upward movement of buttonhead 21 and stem 23 allows the balls 27 to ride inwardly on the conically shaped portion 26 of stem 23 and away from the ledges 28 and 29 formed in cam gear 17. Thus with the balls out of contact with the ledges 28 and 29, the cam rod 16 is free to move upwardly under the action of biasing spring 30 the lower end of which rests upon washer 31 which rests atop main gear 10 and the upper end of which engages the flange of holding ring 32 threadedly secured about the upper threaded end of cam rod 16 and held in place by set screw 33. Upward movement of cam rod 16 imparts clockwise rotation as viewed from above to helix cam 18 and to cam gear 17 relative to main housing 12 and to main gear 10.

Figure 5:
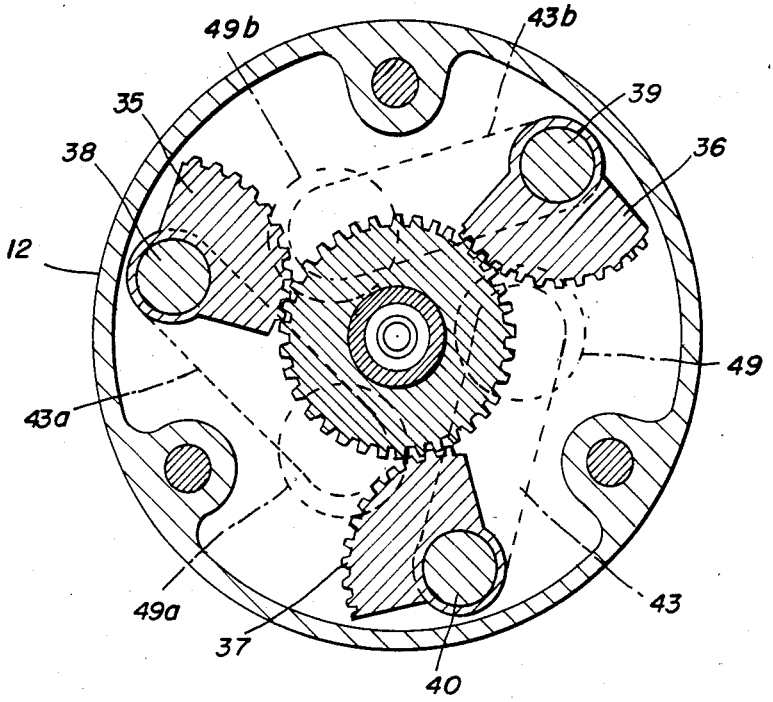
FIG. 5 is a cross sectional view taken along the line designated 5—5 in FIG. 1.

This rotation of cam gear 17 relative to housing 12 causes the segments 35, 36 and 37 best shown in FIG. 5 to rotate in a counterclockwise direction about the axes of clamp shafts 38, 39 and 40 and to so rotate these clamp shafts.

Since all the clamping segments 35, 36, 37 and the clamping shafts 38, 39 and 40 are identical, the function and structure of only one such clamping shaft and its associated structure are here described. As is apparent from FIG. 3, the clamping shaft 39 is rotatable within a bearing 42 disposed within main housing 12 and bearing 42*a* in housing closure 12*a* secured in place by screws 12*h*, 12*c* and 12*d* and plug 12*e* closes a lubricating hole in closure 12*a* and plug 12*g* closes a lubricating hole in main housing 12 and grease fitting 12*f* screwed into main housing 12. Arm 43 is clamped onto shaft 39 by clamps 44*b* and 44*c* which include arcuate surfaces for enveloping shaft 39 when inserted into hole 44*a* and are held in position by screw 44*a* and located in Proper angular position by dowel 44. A cap gripper 45 is mounted by a bolt 46 and a nut 47 to the outer end of clamping arm 43. Gripper 45 includes an eccentric sleeve 48 about which a knurled end cup 49 is mounted in threaded relation. A helical spring 50 is arranged with its lower end in connection with the eccentric sleeve 48 and its upper end secured to a part of clamping arm 43.

With the clamping arms and associated structure arranged as shown in FIG. 3, the chuck is lowered to cause the buttonhead 21 to engage the top surface of a cap to be applied. The resetting upward motion of buttonhead 21 of the associated mechanism described above imparts rotation to the clamping shafts 38, 39, 40 and to their associated clamping segments 35, 36 and 37 which in turn imparts swinging cap gripping movement to clamping arm 43 and to the other two arms 43*a* and 43*b*. This causes the cap grippers 49, 49*a* and 49*b* lightly to grip a container cap and the cap and its container are brought into registry. Thereafter rotary motion imparted by driving spindle 1*a* to bell housing 1 and to main housing 12 causes the grippers 49, 49*a* and 49*b* to roll around the perimeter of the container cap. This action causes the grippers to rotate because of the knurled surfaces of the cap skirt and of the grippers 49, 49*a* and 49*b*, which mesh due to the free rotation of the grippers. Rubber covered grippers are preferable for smooth skirts. During rotation of the grippers, the eccentric sleeves such as 48 bring substantial pressure to bear on the perimeter of the cap which in turn frictionally locks the grippers to the cap and imparts the desired torque to the container caps. The limit of travel of each of the grippers such as 45 is limited by a stop pin such as is indicated at 52. Downward movement of reset rod 1*b* which is conventional in known capping machines causes cam rod 16 to move downwardly in the helix cam 18 and in main gear 17 causing these parts to move counterclockwise as viewed from above which through gripper arms 43, 43*a* and 43*b* and grippers 45 release the gripped cap. Simultaneously the spindle of the capping machine elevates the chuck out of contact with the container cap and as cam rod 16 continues to move downwardly to a position where the locking balls 27 are free to move outwardly due to engagement with conical portions 26 of stem 23. The balls are held outwardly by portion 26*a* of stem 23. Thereafter spring 51 moves stem 23 downwardly to the position shown in FIG. 3. Balls 27 are effective to hold the cam rod 16 in the position shown in FIG. 3.

The degree of tightness which is applied by way of torque to the cap is controlled by the frictional relationship between washers 60 and 61. These parts are spring loaded by compression springs 62 and the pressure is adjustable by means of adjusting ring 7 which when rotated in one direction increases the spring pressure and which when rotated in the opposite direction decreases the frictional relation between these parts 60 and 61. Rotation of the main housing 12 relative to washer 61 is prevented by pins 63 while rotation between washer 60 and bell housing 1 is prevented by pins 64 and flange 65 of cylinder 66 and float washer 70 and by pins 67 and float washer 70 and flange 68 of bell housing 1.

Thrust washer 71 is interposed between flange 8 and flange 11 to accommodate wear when the cap is fully tightened and the lower housing assembly stops turning while the flange 8 and spindle 1*a* continue turning. Thrust washer 71*a* is identical to washer 71 and is between part 6 and flange 68 of bell housing 1 to accommodate wear due to floating action caused by misalignment of chuck relative to the container cap. Flange 11 and flange 8 are held together by threaded retaining ring 7*a*.

Figure 6:
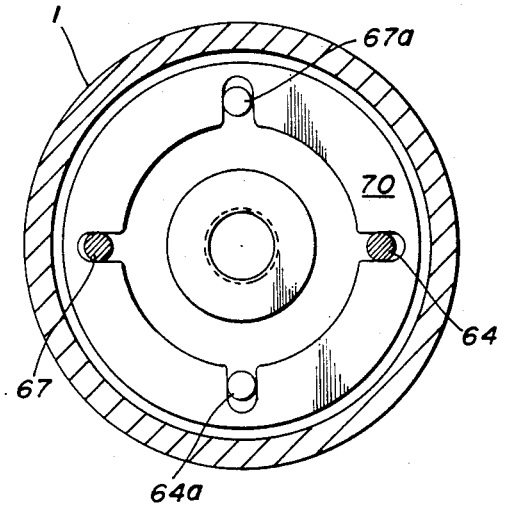
FIG. 6 is a cross sectional view taken along the line designated 6—6 in FIG. 1.

To allow for slight misalignment between the chuck and the container to be capped the pins 64 and 67 and 64*a* and 67*a* are diametrically arranged in slots formed in float washer 70 which allow about one-eighth inch float as shown in FIG. 6.

Figure 7:
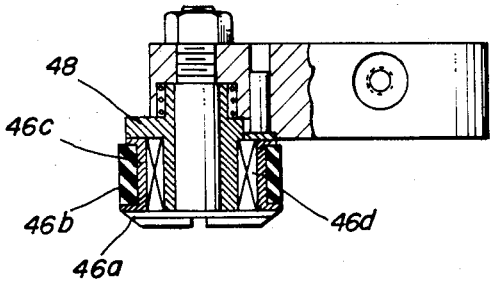
FIG. 7 is a fragmentary view partially in section of a modified eccentric gripping device formed according to one aspect of this invention.

FIG. 7 shows an alternative gripper which distributes wear. Needle roller clutch 46*d* is mounted on eccentric bushing 48 and locks when tightening a cap and overruns freely in the opposite direction a fraction of a complete rotation when released to distribute wear on rubber roller 46*b* stretched on flanged sleeve 46*c* into which needle roller clutch 46*d* is pressed. Bolt 46*d* mounts the gripper assembly to gripper arm 43.

For converting the gripper for use with caps having knurled skirts the parts 46*b*, 46*c* and 46*d* are removed from bolt 46*a* and replaced by a steel knurled sleeve 48*a* by mounting that sleeve about projection 48*b* of eccentric 48 so that pin 48*c* enters hole 48*d* of eccentric 48.

Figure 8:
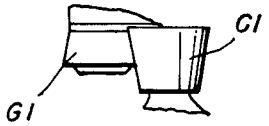
FIGS. 8, 9 and 10 show alternative contoured grippers.
Figure 10:
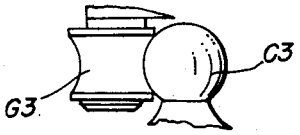
Figure 9:
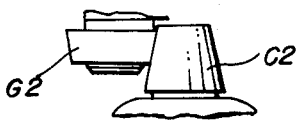
Figure 11:
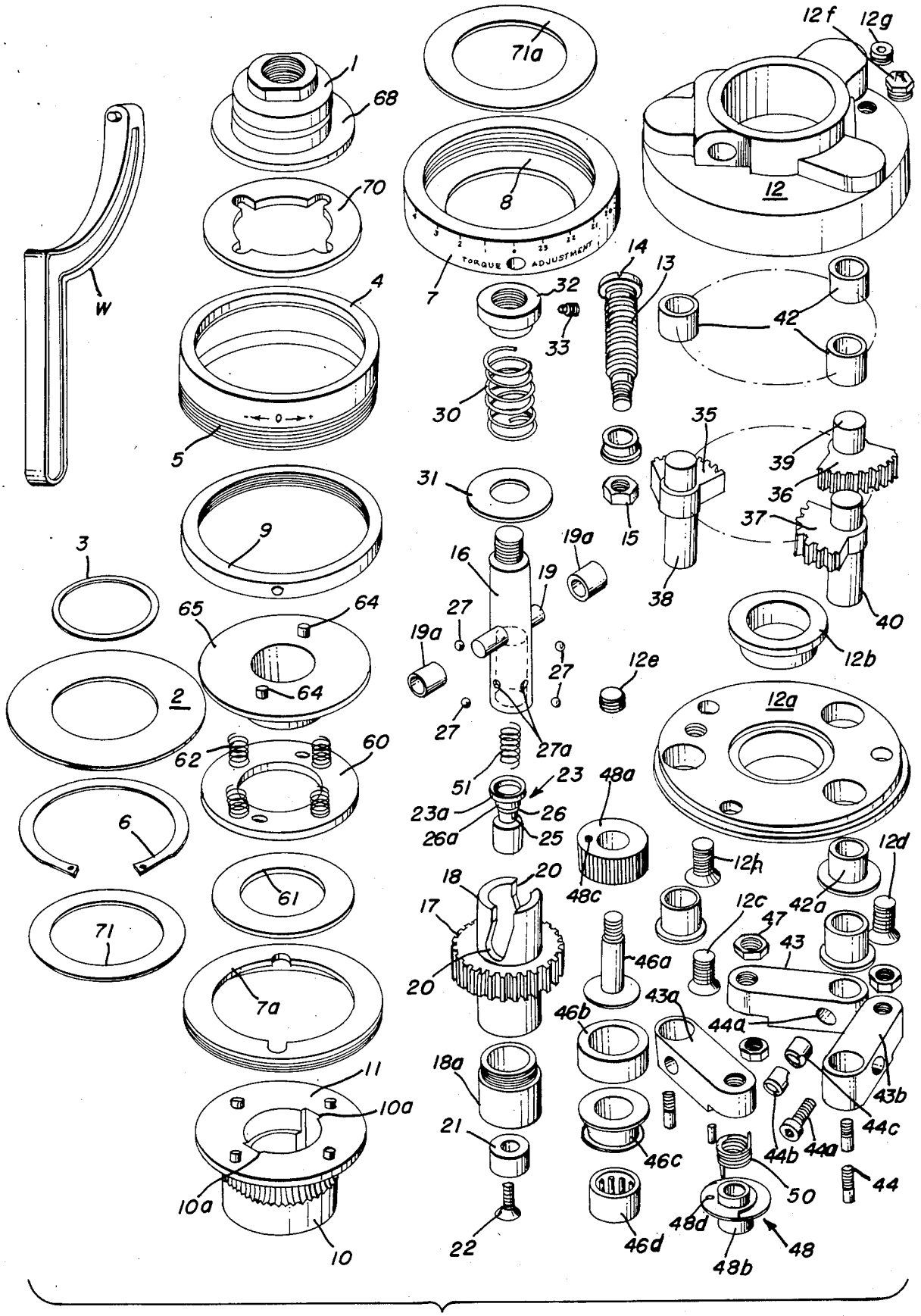
FIG. 11 is an exploded view of the type of chuck shown in FIGS. 1–7.

FIGS. 8, 9 and 10 represent variations in contoured grippers G1, G2 and G3 which are applicable for use with caps C1, C2 and C3 having skirts of tapered or spherical configuration as is obvious.

For adjusting the chuck for use in conjunction with caps of different diameters, rotation of worm 13 simply causes the main housing 12 to rotate relative to main gear 10 to impart substantial angular rotation to the clamping segments 35, 36 and 37 together with their associated clamping rods, clamping arms and cap grippers so as to swing the grippers from closely spaced positions for use with small caps as shown for example in dotted lines in FIG. 5 to widely spaced positions for use with large caps as shown in solid lines in FIG. 4. An actual apparatus is adjustable for use with caps of 20 MM in diameter to 120 MM in diameter.

INDUSTRIAL APPLICABILITY

By this invention, a capping apparatus is provided which efficiently effects capping operations and which is readily adaptable for use in conjunction with container caps of different diameters thereby rendering unnecessary the provision of separate chucks for each diameter cap which is to be applied to a container. Furthermore the gripping action of this invention is applicable for use in conjunction with gripping a variety of objects other than container caps.

I claim:

1. Adjustable apparatus for capping containers of different cap sizes said apparatus comprising a main housing arranged for rotation by a driving spindle, a main gear having an axis and gear teeth about at least a portion of its periphery and disposed within said main housing, a helix cam including a cam gear coaxially disposed with respect to said main gear, a plurality of clamp shafts disposed about said main gear and said cam gear and rotatably mounted in said main housing and having outer ends projecting out of said main housing, a plurality of gear segments respectively mounted on said clamp shafts and having gear teeth in operative engagement with the teeth of said cam gear for respectively angularly shifting said clamp shafts in coordination with relative angular movement of said main housing and said main gear, a plurality of clamp arms secured respectively to said outer ends of said clamp shafts, and a plurality of cap grippers mounted on said clamp arms respectively for engaging a container cap about its periphery, and adjusting means for imparting relative angular movement to said main housing and said cam gear about the axes of said cam and said main gears.

2. Adjustable apparatus according to claim 1 wherein said adjusting means includes a worm gear rotatably mounted in said main housing and in cooperative engagement with the teeth of said main gear.

3. Adjustable apparatus according to claim 1 wherein each of said cap grippers comprises an eccentric sleeve rotatably mounted on a shaft affixed to each of said clamp arms.

4. Adjustable apparatus according to claim 3 wherein each of said cap grippers includes a torsion spring having one end secured to the associated eccentric sleeve and the other end secured to the associated clamp arm for rotating said sleeve back to a normal position after completion of a capping operation.

5. Adjustable apparatus according to claim 3 wherein a knurled sleeve is secured about said eccentric sleeve and wherein the cap skirt is knurled to mesh with said knurled sleeve, the sleeve being freely rotatable so as to mesh with the cap.

6. Adjustable apparatus according to claim 3 wherein a sleeve of pliable high friction material is secured about said eccentric sleeve

7. Adjustable apparatus according to claim 1 wherein a cam rod is disposed within a central aperture formed in said cam gear and in coaxial relation therewith, a cam follower shaft disposed in a transverse passage in said cam rod and having outwardly projecting ends on which cam followers are rotatably mounted diametrically opposed spiral cam tracks formed in said cam gear for receiving said outwardly projecting ends of said cam follower shaft, vertical cam tracks formed in said main gear for receiving said outwardly projecting ends of said cam follower shaft, biasing means urging said cam rod upwardly, releasable latch means for holding said cam rod against movement by said biasing means, activating means for releasing said latch means whereby upward movement is imparted to said cam rod causing movement of said cam follower shaft in said cam tracks and resulting in limited angular movement of said cam gear relative to said main gear and angular movement of said gear segments, clamp shafts, clamp arms and light cap engaging movement of said cap grippers.

8. Adjustable apparatus according to claim 7 wherein said releasable latch means comprises four equally spaced apertures formed in the lower portion of said cam rod, four equally spaced locking balls disposed in said apertures respectively and in engagement with an inwardly projecting ledge formed in said cam gear for holding said cam rod in locked position against vertical movement relative to said cam gear, and a cap button stem having a first peripheral surface for engaging said locking balls for holding said locking balls and said stem in their cam rod locking positions and also having a second peripheral surface below said first peripheral surface and of smaller diameter for receiving said locking balls upon upward movement of said cap button stem thereby to release said cam rod for upward movement relative to said cam gear in response to engagement of said cap button stem with a cap to be applied to a container.

9. Adjustable apparatus according to claim 1 wherein a bell housing having an outer flange is secured to and rotatable with said spindle and a friction washer is affixed to said main gear for functional engagement with said outer flange and wherein adjustable means controls the bearing pressure between said outer flange and said washer thereby to control the degree of tightness of the cap on the container.

10. Adjustable apparatus according to claim 9 wherein said adjustable means comprises a cylindrical element threadedly related with said bell housing and having an inwardly projecting flange enveloping an outwardly projecting flange on said main gear.

11. Adjustable apparatus according to claim 10 wherein a locking ring is threadedly related with said bell housing and engageable with said cylindrical element for locking said cylindrical element in a predetermined position.

12. Adjustable apparatus according to claim 10 wherein said cylindrical element includes calibrating indicia for indicating particular degrees of cap tightening torque.

13. Adjustable apparatus according to claim 8 wherein a push rod is disposed within said spindle and movable downwardly into engagement with the upper end of said cam rod for moving said cam rod downwardly relative to said cam gear thereby to cause angular movement of said cam gear to release the cap grip and lock said cam rod in its downward position.

14. Adjustable apparatus according to claim 8 wherein said peripheral surfaces on said cap button stem are spaced apart axially and interconnected by a conical structure interposed therebetween for facilitating movement of said locking balls between said peripheral surfaces.

15. Adjustable apparatus according to claim 9 wherein said bell housing includes an outwardly disposed flange having a pair of diametrically disposed apertures having a pair of downwardly projecting pins and wherein a driving cup having an outer flange and having diametrically disposed apertures in its flange is disposed about said cam rod and within said main gear and in which a pair of upwardly extending pins are disposed in said apertures formed in the flange of said driving cup, the pairs of pins being displaced from each other by 90 degrees, and a float washer disposed between said flanges and having radial slots formed in its inner periphery and disposed at 90 degrees to each other, the radial length of said slots being longer than the diameter of said pins whereby said main housing and associated parts is rendered free to shift position relative to said bell housing thereby to accommodate slight misalignment between the apparatus and the container to be capped.

16. Container capping apparatus comprising a main housing arranged for rotation by a driving spindle, a cam rod coaxially disposed relative to said spindle and reciprocably movable, biasing means urging said cam rod upwardly, releasable holding means normally restraining said cam rod against upward movement, a transverse cam follower shaft mounted in a transverse passage formed in said cam rod and having outwardly projecting ends, a main cam fixed in position relative to main housing and disposed about said cam rod and having opposed vertical cam tracks in which said outwardly projecting ends of said transverse cam follower shaft are disposed, a helix cam arranged for limited angular movement and disposed about said cam rod and within said main cam and having opposed helical cam tracks in which said outwardly projecting ends of said transverse cam follower shaft are disposed whereby limited angular movement is imparted to said helix cam simultaneously with upward movement of said cam rod due to action of said biasing means upon release of said cam rod by said releasable holding means, and gripping means supported by said housing for lightly gripping a container cap in coordination with said limited angular movement of said helix cam.

17. Container capping apparatus according to claim 16 wherein adjustable means is arranged to change the angular position of said main cam relative to said main housing thereby to adapt said apparatus for use in conjunction with container caps of different diameters.

18. Container capping apparatus according to claim 16 wherein said gripping means includes an eccentric rotatable gripper arranged to roll about the skirt of a container cap and frictionally related therewith for screwing the cap onto its container.

19. Container capping apparatus according to claim 16 wherein said cam rod is hollow and wherein said releasable holding means comprises diametrically opposed openings formed in said cam rod in which locking balls are disposed, said locking balls being in engagement with shoulders formed on said helix cam when in locking positions thereby to prevent upward movement of said cam rod under the action of said biasing means, and a stem reciprocable within said cam rod and having a first portion at its upper end which is sufficently large in diameter to hold said locking balls in their locking positions when in engagement therewith and said stem having a second portion of smaller diameter than said first portion so that upward movement of said stem allows said locking balls to enter said second portion of said stem and to disengage said shoulders formed on said helix cam thereby to release said cam rod for upward resetting movement under the action of said biasing means.

20. Container capping apparatus according to claim 19 wherein a stem spring is disposed above and in engagement with the upper end of said stem and with a part of said cam rod for biasing said stem downwardly so as to hold said locking balls in locking positions.

21. Container capping apparatus according to claim 19 wherein a cap button is affixed to the lower end of said stem for engaging a container cap thereby to impart upward movement to said stem so as to reset the apparatus to perform a subsequent cap tightening operation.

22. Container capping apparatus comprising a main housing having a vertical axis, a plurality of grippers movably supported by said housing and disposed about said axis, vertically reciprocable means disposed within said main housing and coaxially arranged relative to said vertical axis biasing means arranged to bias said vertically reciprocable means upwardly, releasable holding means arranged to prevent upward movement of said vertically reciprocable means, operating means coaxially disposed relative to said vertical axis and arranged for limited angular movement about said vertical axis as a center and operably interrelating said vertically reciprocable means and said grippers for imparting limited inward movement to said grippers in coordination with release of said vertically reciprocable means by said releasable holding means.

23. Container capping apparatus according to claim 22 wherein said holding means is released in coordination with engagement thereof with a container cap.

24. Container capping apparatus according to claim 22 wherein the normal radial distance of said grippers from said vertical axis is adjustable by movable means arranged to determine and to change the positional relationship between said main housing and said operating means thereby to adapt the apparatus for use with container caps of different diameters.

* * * * *